US007068968B2

(12) United States Patent
Choi et al.

(10) Patent No.: US 7,068,968 B2
(45) Date of Patent: Jun. 27, 2006

(54) WASTE TONER TRANSFER APPARATUS AND ELECTROPHOTOGRAPHIC PRINTER ADOPTING THE SAME

(75) Inventors: Jae-myoung Choi, Suwon-si (KR); Heung-sup Jeong, Suwon-si (KR); Se-hyun Lyu, Seoul (KR); Jin-soo Lee, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 77 days.

(21) Appl. No.: 10/834,201

(22) Filed: Apr. 29, 2004

(65) Prior Publication Data

US 2005/0002707 A1 Jan. 6, 2005

(30) Foreign Application Priority Data

Jul. 4, 2003 (KR) ..... 10-2003-0045388

(51) Int. Cl.
*G03G 21/12* (2006.01)
*G03G 21/10* (2006.01)

(52) U.S. Cl. ..... 399/360; 399/358

(58) Field of Classification Search ..... 399/99, 399/358, 360

See application file for complete search history.

(56) References Cited

U.S. PATENT DOCUMENTS

| | | | | |
|---|---|---|---|---|
| 4,958,196 | A * | 9/1990 | Fujii et al. | 399/360 |
| 5,113,227 | A | 5/1992 | Miyasaka | |
| 5,130,756 | A * | 7/1992 | Taniyama | 399/358 |
| 5,204,720 | A | 4/1993 | Ishida et al. | 355/260 |
| 5,534,988 | A * | 7/1996 | Gerbasi | 399/358 |
| 6,014,541 | A * | 1/2000 | Kato et al. | 399/358 |
| 6,085,062 | A * | 7/2000 | Mizuishi et al. | 399/358 |
| 6,266,511 | B1 | 7/2001 | Murakami et al. | 399/358 |

FOREIGN PATENT DOCUMENTS

| | | |
|---|---|---|
| JP | 05-319539 | 12/1993 |
| JP | 09325662 | 12/1997 |
| JP | 11-084971 | 3/1999 |
| JP | 2001350382 | 12/2001 |
| KR | 1988-0012982 | 8/1988 |
| KR | 89-5387 | 4/1989 |
| KR | 1991-0020519 | 12/1991 |
| KR | 94-16977 | 7/1994 |
| KR | 0125954 | 12/1998 |
| KR | 1999-029393 | 4/1999 |

* cited by examiner

*Primary Examiner*—Sandra L. Brase
(74) *Attorney, Agent, or Firm*—Roylance, Abrams, Berdo & Goodman, L.L.P.

(57) ABSTRACT

A waste toner transfer apparatus in an electrophotographic printer for transferring waste toner removed by a cleaning unit from an image holding body, where a toner image is temporarily held, to a waste toner storage container. The waste toner apparatus includes a duct for connecting the cleaning unit and the waste toner storage container, a transfer unit installed in the duct to transfer the waste toner, a guide portion provided at an outlet of the duct to be inclined downward to guide the waste toner toward the waste toner storage container, and an agitation member installed on the guide portion and moving to prevent the waste toner from accumulating on the guide portion.

16 Claims, 9 Drawing Sheets

WASTE TONER TRANSFER APPARATUS AND ELECTROPHOTOGRAPHIC PRINTER ADOPTING THE SAME

BACKGROUND OF THE INVENTION

This application claims the benefit under 35 U.S.C. § 119(a) of Korean Patent Application No. 2003-45388, filed on Jul. 4, 2003, in the Korean Intellectual Property Office, the entire disclosure of which is incorporated herein by reference.

FIELD OF THE INVENTION

The present invention relates to an electrophotographic printer. More particularly, the present invention relates to a waste toner transfer apparatus to transfer waste toner generated during a printing process to a waste toner storage container and an electrophotographic printer adopting the same.

DESCRIPTION OF THE RELATED ART

In an image forming process of an electrophotographic printer, when an exposure unit scans light corresponding to image information onto a photoreceptor that is charged to a predetermined electric potential, an electrostatic latent image is formed on the photoreceptor. A developing unit supplies toner to the electrostatic latent image to form a toner image. Generally, four developing unites containing toners for cyan, magenta, yellow, and black colors are needed for a color electrostatic latent printer. The toner image is transferred onto a recording medium directly, or via an intermediate medium, from the photoreceptor. While the recording medium passes through a fusing unit, the toner image is fused onto the recording medium by heat and pressure. As a result of the above processes, a mono or color image is printed on the recording medium.

While a wet type electrophotographic printer uses a wet developer formed by dispersing toner powder in a liquid carrier, a dry type electrophotographic printer uses toner powder as a developer. Waste toner remaining on the photoreceptor or intermediate transfer medium during the image forming process is removed therefrom. The removed waste toner is collected in a waste toner storage container. The electrophotographic printer typically includes a waste toner transfer apparatus to transfer waste toner to the waste toner storage container.

FIG. 1 is a view illustrating a conventional waste toner transfer apparatus. FIG. 2 is a sectional view illustrating a portion A of FIG. 1.

Referring to FIGS. 1 and 2, a cleaning apparatus 1 comprising an auger 9 removes waste toner from the photoreceptor or intermediate transfer medium. The waste toner removed by the cleaning apparatus 1 is transferred by a waste toner transfer apparatus 2 to a waste toner storage container 10. The waste toner enters a duct 4 through an inlet portion 3. A shaft 5 rotated by a drive motor 6 is installed in the duct 4, and a conveying coil 7 is coupled to an end portion of the shaft 5. The duct 4 and the waste toner storage container are connected by a pipe 8. The conveying coil 7 is installed to extend through the inside of the pipe 8. The waste toner that enters the duct 4 through the inlet portion 3 is transferred by the conveying coil 7 to the waste toner storage container along the pipe 8.

Referring to FIG. 2, a guide portion 20 guides the waste toner coming out of the pipe 8 toward a waste toner storage container 10. The guide portion 20 is inclined downward toward an inlet 11 of the waste toner storage container 10 from an outlet of the pipe 8. The waste toner coming out of the pipe 8 falls on the guide portion 20 and slides down into the waste toner storage container 10 based on gravity.

In the waste toner transfer apparatus 2 configured as above, although the guide portion 20 is inclined downward so that the waste toner slides down, waste toner particles sometimes coagulate into a waste toner lump due to an attraction force between the toner particles so that the waste toner remains on the guide portion 20 without falling into the waste toner storage container 10. When the waste toner is left for a long time in an environment of high temperature and high humidity, the waste toner hardens and accumulates on the guide portion 20. The hardened waste toner then prevents the waste toner that falls on the guide portion 20 from sliding down so that the amount of waste toner accumulated on the guide portion 20 gradually increases. As the process proceeds, as shown in FIG. 2, the guide portion 20 becomes completely clogged by the hardened waste toner.

SUMMARY OF THE INVENTION

To solve the above and/or other problems, embodiments of the present invention provides a waste toner transfer apparatus which effectively transfers waste toner removed from an image holding body, such as a photoreceptor or an intermediate transfer medium to a waste toner storage container, so that the waste toner does not accumulate during the transfer process, and an electrophotographic printer having the same.

According to an aspect of the present invention, there is provided a waste toner transfer apparatus in an electrophotographic printer to transfer waste toner removed by a cleaning unit from an image holding body, where a toner image is temporarily held, to a waste toner storage container. The waste toner transfer apparatus comprises a duct connecting the cleaning unit and the waste toner storage container, a transfer unit installed in the duct to transfer the waste toner, a guide portion disposed at an outlet of the duct and inclined downward to guide the waste toner toward the waste toner storage container, and an agitation member installed on the guide portion and moving to prevent the waste toner from accumulating on the guide portion.

According to another aspect of the present invention, there is provided an electrophotographic printer including an image holding body for temporarily holding a toner image in an image forming process, a cleaning unit for removing waste toner remaining on the image holding body, a waste toner storage container, and a waste toner transfer apparatus for transferring the waste toner from the cleaning unit to the waste toner storage container. The waste toner transfer apparatus comprises a duct connecting the cleaning unit and the waste toner storage container, a transfer unit installed in the duct to transfer the waste toner, a guide portion disposed at an outlet of the duct and inclined downward to guide the waste toner toward the waste toner storage container, and an agitation member installed on the guide portion to move, and to thereby prevent the waste toner from accumulating on the guide portion.

The agitation member preferably moves by being engaged with the transfer unit. The transfer unit comprises a rotating shaft, a conveying coil coupled to the shaft for rotating, wherein the waste toner transfer apparatus further comprises a cam member having a cam profile and coupled to one end portion of the conveying coil close to the waste toner storage container and, as the cam member rotates, the agitation member contacts the cam profile and moves.

The transfer unit preferably comprises an auger having a shaft and a spiral wing formed on an outer circumference of the shaft for rotating, and a conveying coil coupled to the shaft for rotating together with the auger. A cam member having a cam profile is coupled to one end portion of the conveying coil and, as the cam member rotates, the agitation member contacts the cam profile and moves.

The duct comprises a first duct in which the waste toner enters from the cleaning unit, a second duct connected to the first duct, and a third duct which is soft and connects the second duct and the waste toner storage container, and the auger is installed in the second duct and the conveying coil is coupled to the auger and inserted in the third duct.

BRIEF DESCRIPTION OF THE DRAWINGS

The above and other features and advantages of the present invention will become more apparent by describing in detail preferred embodiments thereof with reference to the attached drawings in which.

Throughout the drawings, it should be understood that like reference numbers refer to like features and structures.

DETAILED DESCRIPTION OF THE PREFERRED EMBODIMENTS

Figure 1:
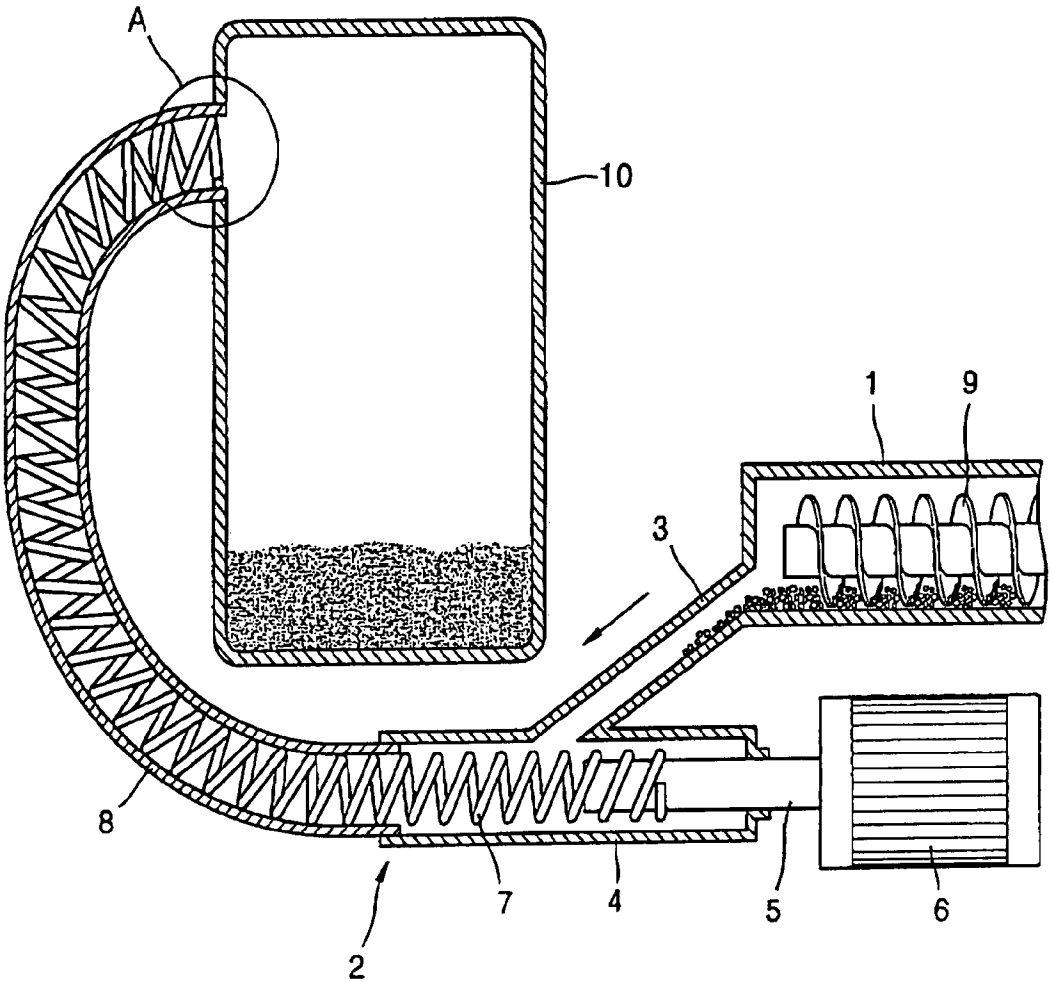
FIG. 1 (PRIOR ART)
FIG. 1 is a view illustrating a conventional waste toner transfer apparatus.
Figure 2:
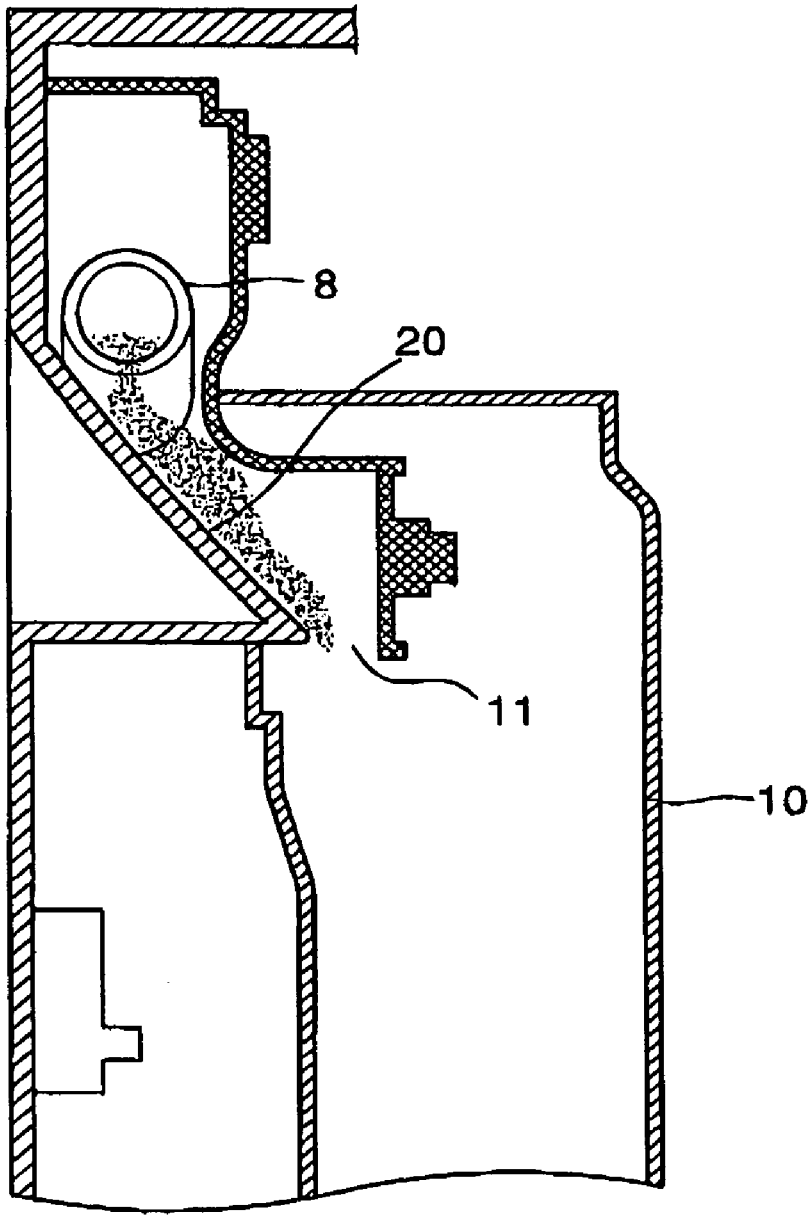
FIG. 2 (PRIOR ART)
FIG. 2 is a sectional view illustrating a portion A of FIG. 1.
Figure 3:
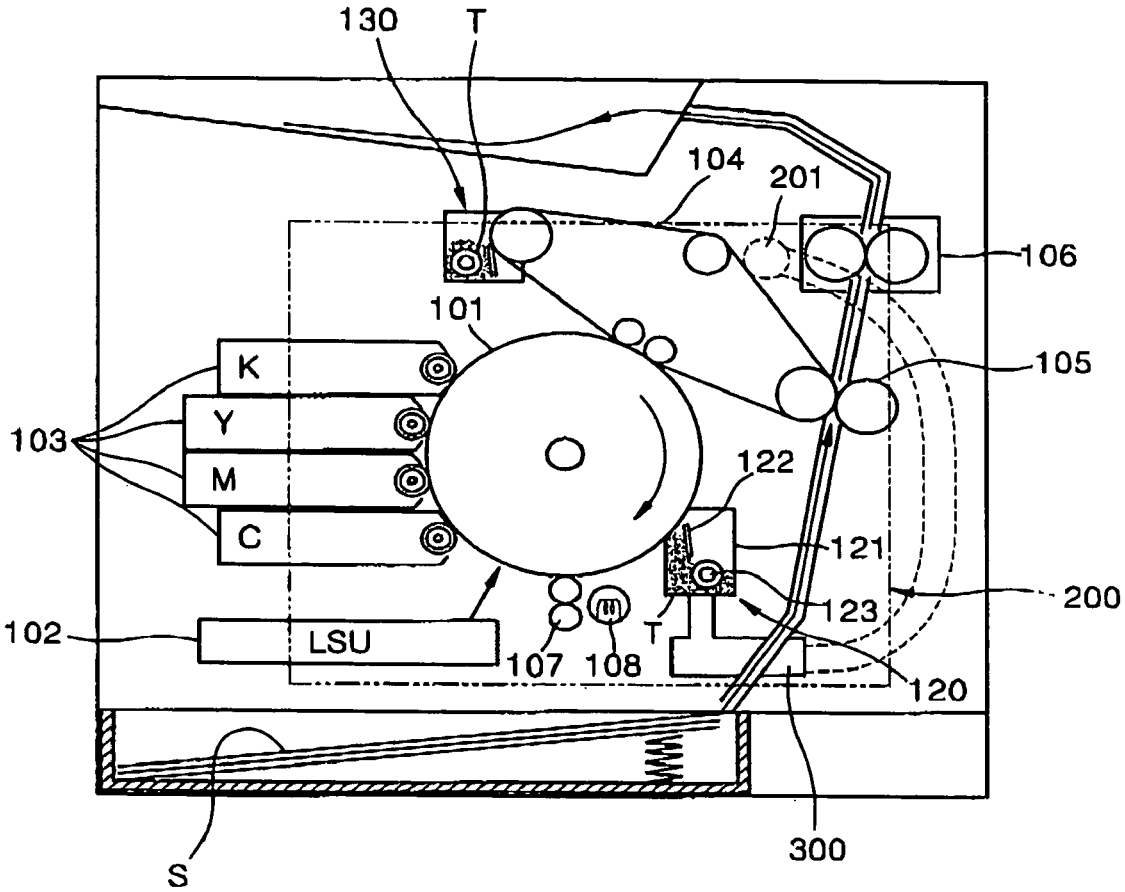
FIG. 3 is a view illustrating the structure of an electrophotographic printer according to an embodiment of the present invention.

Referring to FIG. 3, an electrophotographic printer according to an embodiment of the present invention includes a photoreceptive drum 101, an exposure unit 102, a developing unit 103, and a transfer belt 104.

Figure 4:
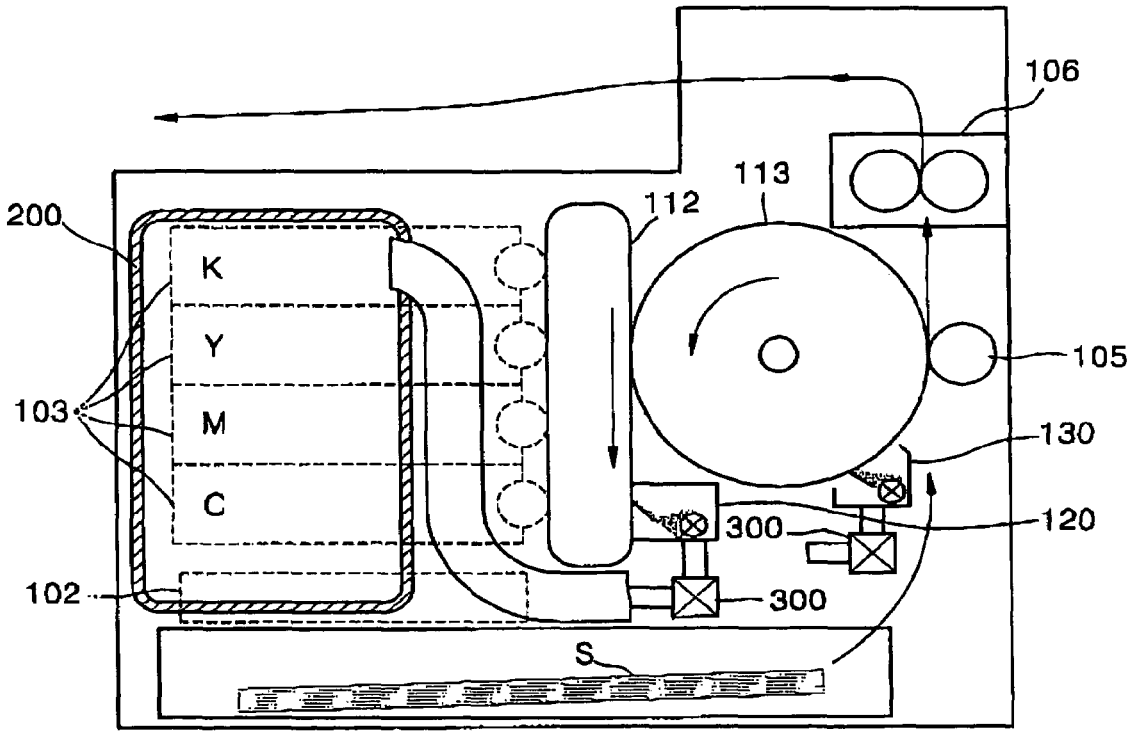
FIG. 4 is a view illustrating the structure of an electrophotographic printer according to another embodiment of the present invention.

The photoreceptive drum 101, as an example of a photoreceptor, has a photoconductive substance layer formed on the outer circumferential surface of a metal drum. A photoreceptive belt 112 as shown in FIG. 4 can be used instead of the photoreceptive drum 101. Also, it should be understood that the present invention is useful in any device that removes toner to a waste toner storage container, including devices with non-photoreceptive drums or belts. Examples include electrostatic drums and belts, among others.

The exposure unit 102 forms an electrostatic latent image by scanning light corresponding to image information onto the photoreceptor drum 101 which is charged to a uniform electric potential. Generally, a laser scanning unit (LSU) using a laser diode as a light source is used as the exposure unit 102.

Four developing units 103C, 103M, 103Y, and 103K respectively contain solid powder toners for cyan (C), magenta (M), yellow (Y), and black (K) colors, and provide the toners to the electrostatic latent image formed on the photoreceptive drum 101 to form toner images.

The transfer belt 104 is an example of an intermediate transfer medium which transfers the toner image received from the photoreceptor to a recording medium S. A transfer drum 113 as shown in FIG. 4 can be used instead of the transfer belt 104. The toner images for cyan (C), magenta (M), yellow (Y), and black (K) colors sequentially formed on the photoreceptive drum 101 are transferred to the transfer belt 104, in order, overlap so that a color toner image is formed. Preferably, the running linear velocity of the transfer belt 104 is the same as the rotating linear velocity of the photoreceptive drum 101. The length of the transfer belt 104 must be the same as or at least longer than the length of the recording medium S where the color toner image is finally transferred.

The transfer roller 105 is installed to face the transfer belt 104. The transfer roller 105 is separated from the transfer belt 104 when the color toner image is transferred to the transfer belt 104. When the color toner image is completely transferred to the transfer belt 104, the transfer roller 105 contacts the transfer belt 104 with a predetermined pressure to transfer the color toner image to the recording medium S. When the recording medium S to which the toner image is transferred passes through a fusing unit 106, the toner image is fused onto the recording medium S by heat and pressure. A charger 107 charges the photoreceptive drum 101 to a uniform electric potential. A discharger 108 discharges charges remaining on the photoreceptive drum 101.

The image forming process performed by the electrophotographic printer having the above-described structure is described below.

Color image information includes information on cyan (C), magenta (M), yellow (Y), and black (K) colors. In the present embodiment, the color toner image for cyan (C), magenta (M), yellow (Y), and black (K) colors are sequentially overlapped on the transfer belt 104 and the overlapped image is transferred to the recording medium S. The transferred image is fused onto the recording medium S so that a color image is formed.

When a light signal corresponding to the image information on a cyan (C) color is scanned by the exposure unit 102 onto the photoreceptive drum 101 charged to a uniform electric potential, resistance of a portion of the drum surface where the light is scanned decreases and as a result charges adhering to the external circumferential surface of the photoreceptive drum 101 dissipate. As a result, a difference in electric potential is generated between the scanned portion and the non-scanned portion of the photoreceptive drum 101 so that an electrostatic latent image is formed on the outer circumferential surface of the photoreceptive drum 101. When the electrostatic latent image approaches the developing unit 103C for cyan (C) color as the photoreceptive drum 101 rotates, the toner for cyan (C) color contained in the developing unit 103C adheres to the electrostatic latent image so that a cyan toner image is formed. When the cyan toner image approaches the transfer belt 104 by the rotation of the transfer belt 104, the cyan toner image is transferred onto the transfer belt 104 by the difference in electric potential with the transfer belt 104 and/or a contact pressure. When the cyan toner image is completely transferred to the transfer belt 104, the toner images for magenta (M), yellow (Y), and black (K) are sequentially transferred to the transfer belt 104, in the same process, and overlapped thereon to form a color toner image. When the recording medium S passes between the transfer belt 104 and the transfer roller 105, the color toner image is transferred to the recording medium S. Next, the color toner image is fused by the fusing unit 106 onto the recording medium S by heat and pressure and the recording medium S is ejected completing the image forming process.

The photoreceptive drum 101 and the transfer belt 104 are image holding bodies which temporarily hold a toner image before the toner image is transferred to the recording medium S. Some waste toner remains on the photoreceptive drum 101 and the transfer belt 104 in the process of transferring the toner image to the recording medium S via the photoreceptive drum 101 and the transfer belt 104. The waste toner remaining on the image holding bodies is preferably removed for the next printing. The removed waste toner is held in a waste toner storage container 200 and then disposed of. In some cases, some waste toner reenters the developing unit to be reused. However, for a color image forming apparatus, since different color toners are mixed, generally, the waste toner cannot be reused.

Figure 5:
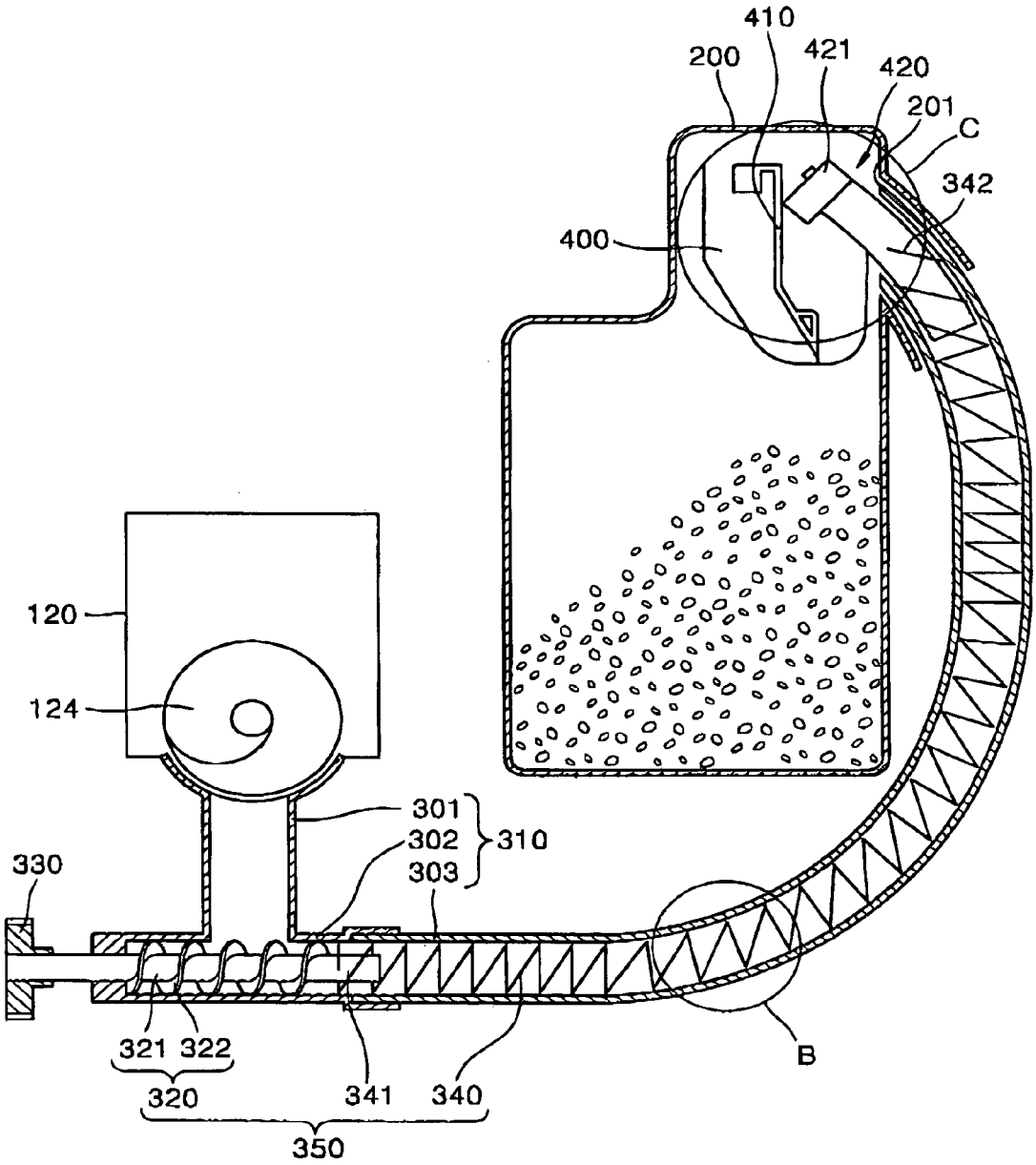
FIG. 5 is a sectional view illustrating a waste toner transfer apparatus shown in FIGS. 3 and 4.

Referring to FIG. 3, a cleaning unit 120 for removing waste toner T from the photoreceptive drum 101 is shown. The cleaning unit 120 includes a housing 121, a blade 122 for contacting the photoreceptive drum 101 to squeegee the waste toner T, and an auger 123 to transfer the waste toner T toward an outlet 124 of FIG. 5 provided at one side end portion of the housing 121. Also, another cleaning unit 130 for removing waste toner T from the transfer belt 104 is provided. The cleaning unit 130 has the same structure as that of the cleaning unit 120 for the photoreceptive drum 101.

Referring to FIG. 5, in the waste toner storage container 200, an inlet 201 through which waste toner enters, is preferably disposed near the top of container 200 to effectively hold the waste toner. In the presently described embodiment of the present invention, since the transfer belt 104 is disposed above the photoreceptive drum 101, the waste toner removed from the transfer belt 104 by the cleaning unit 130 is held in the waste toner storage container 200 directly through the inlet 201 from the cleaning unit 130. However, the waste toner removed from the photoreceptive drum 101 by the cleaning unit 120 is transferred to the waste toner storage container 200 by a waste toner transfer apparatus 300 (see FIG. 3) to overcome a difference in height between the cleaning unit 120 and the inlet 201 of the waste toner storage container 200.

FIG. 4 shows an electrophotographic printer according to another preferred embodiment of the present invention. Referring to FIG. 4, the photoreceptive belt 112 is provided parallel to a transfer drum 113. The cleaning units 120 and 130 for removing waste toner from the photoreceptive belt 112 and the transfer drum 113 are provided. The electrophotographic printer having the above structure needs two waste toner transfer apparatuses 300 to transfer waste toner from the respective cleaning units 120 and 130 to the waste toner storage container 200.

Figure 6:
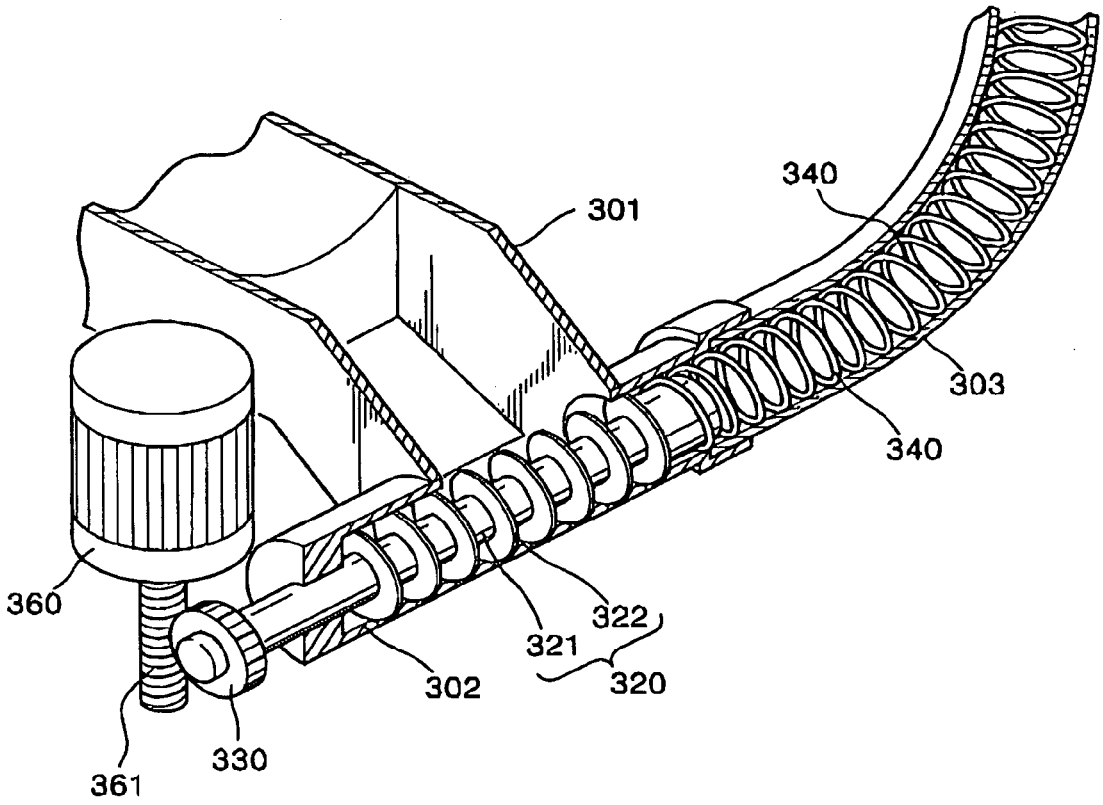
FIG. 6 is a perspective view illustrating the waste toner transfer apparatus shown in FIGS. 3 and 4.
Figure 7:
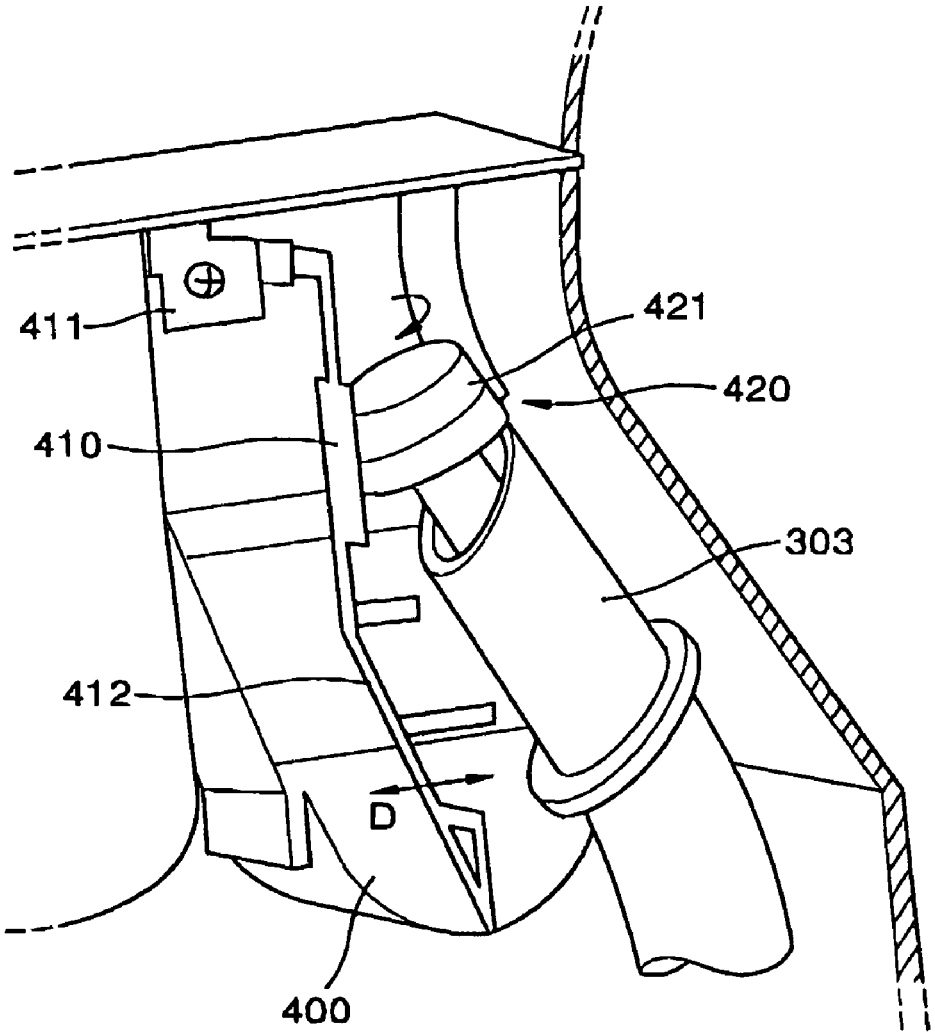
FIGS. 7 and 8 are perspective views illustrating a portion C of FIG. 5 in detail.
Figure 8:
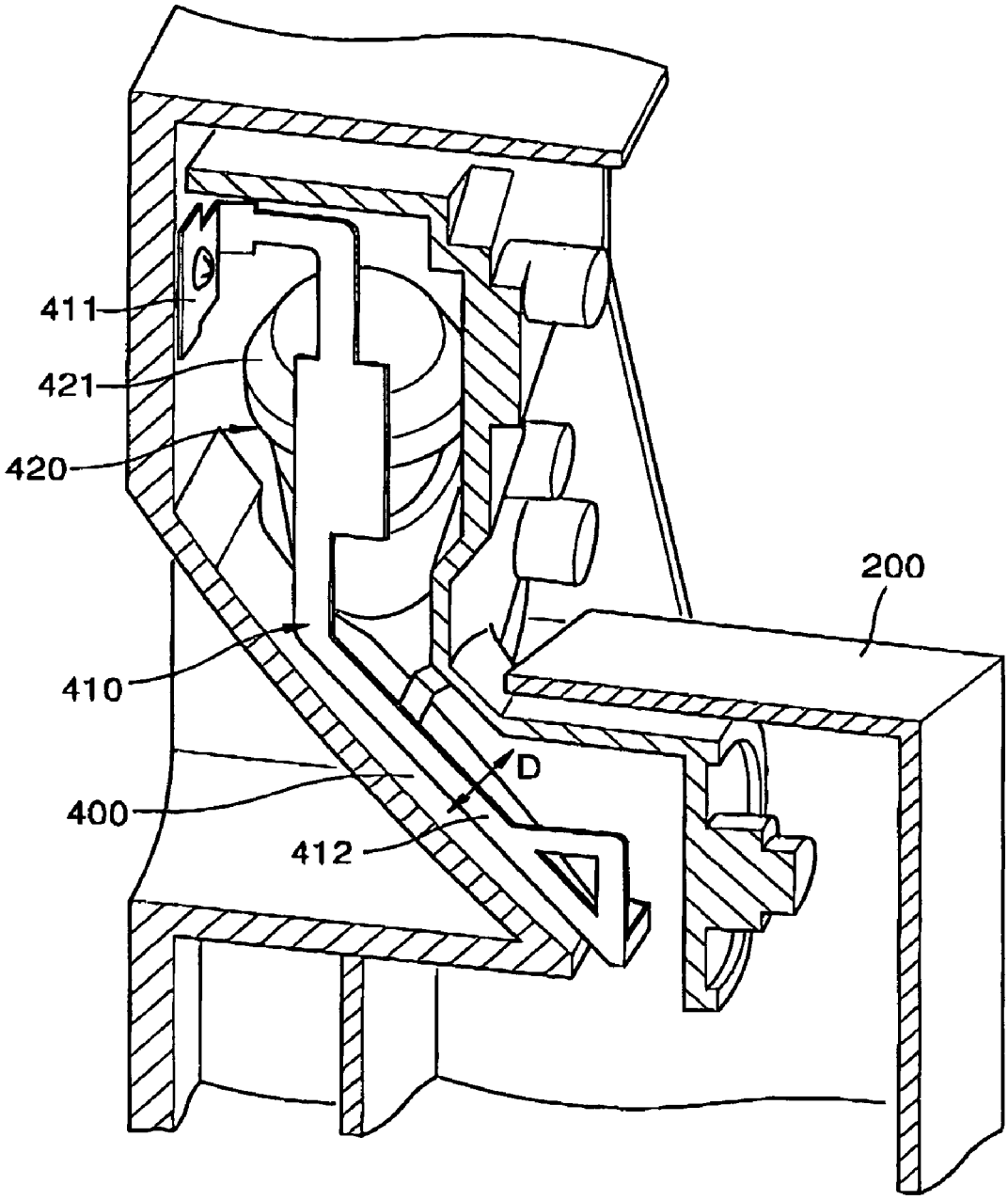

FIGS. 5 and 6 are a sectional view and a perspective view, respectively, illustrating the waste toner transfer apparatus shown in FIGS. 3 and 4. FIGS. 7 and 8 illustrate the portions B and C of FIG. 5 in detail.

Referring to FIGS. 5 and 6, a duct 310 is connected to the outlet 124 of the cleaning unit 120. A guide portion 400 guides the waste toner exiting the duct 310 into the waste toner storage container 200. The guide portion 400 is inclined downward into the waste toner storage container 200 so that the waste toner falling from the duct 310 naturally enters the waste toner storage container 200. A transfer unit 350 for transferring the waste toner is installed in the duct 310.

The duct 310 includes first through third ducts 301, 302, and 303, in the presently described embodiment. The first duct 301 connects the cleaning unit 120 and the second duct 302. The third duct 303 preferably has a flexible circular pipe shape which connects the second duct 302 and the waste toner storage container 200. Thus, a waste toner transfer route is formed from the cleaning unit 120 to the waste toner storage container 200, via the first duct 301, the second duct 302, and the third duct 303.

The transfer unit 350 is installed in the second duct 302 and the third duct 303. The transfer unit 350 may include a shaft 321 installed in the second duct 302 and a conveying coil 340 coupled to an end portion of the shaft 321 and extending to the third duct 303. That is, as shown in FIG. 5, a wing 322 is inserted around the outer circumference of the shaft 321 and extends to the inside of the second duct 302.

To improve waste toner transfer performance, as shown in FIGS. 5 and 6, the transfer unit 350 includes an auger 320 in which a wing 322 having a continuous spiral shape is formed on the outer circumference of the shaft 321 and the conveying coil 340 coupled to one end portion of the shaft 321. A gear 330 is coupled to the other end portion of the shaft 321. A drive motor 360 has a rotation shaft to which a worm gear 361 connected to the gear 330 is coupled. The drive motor 360 rotates the auger 320. One end portion 341 of the conveying coil 340 is coupled to the shaft 321 of the auger 320 and the other end portion 342 is extended to the third duct 303. The conveying coil 340 is rotated together as the auger 320 rotates. The auger 320 is preferably installed in the second duct 302. The auger 320 transfers the waste toner entering in the second duct 302 through the first duct 301, to the third duct 303.

Figure 9:
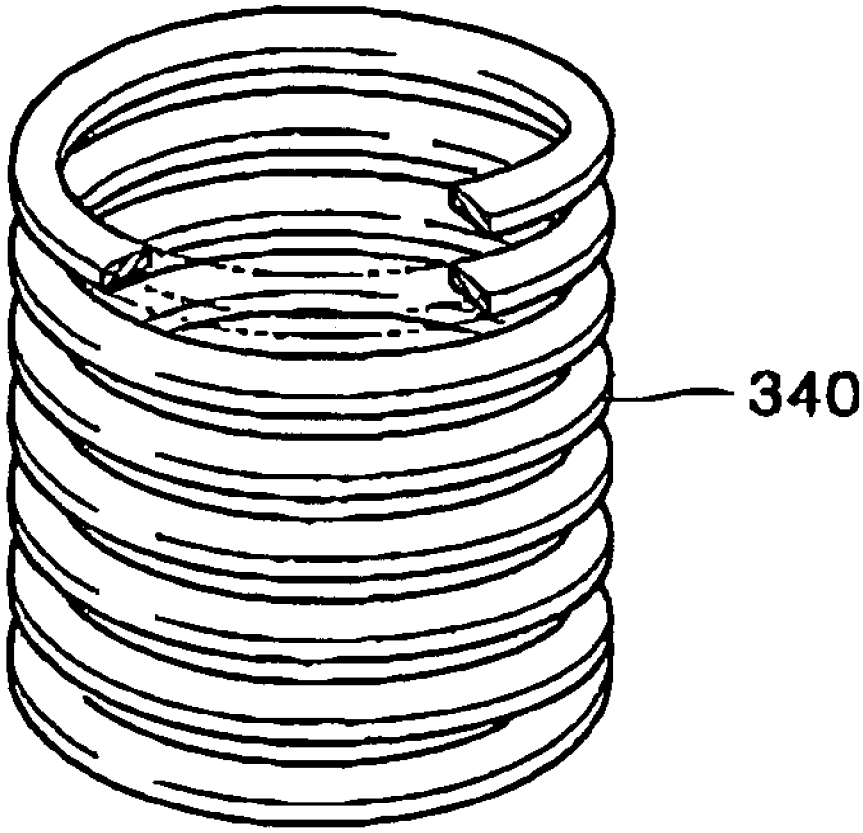
FIG. 9 is a view illustrating a conveying coil according to an embodiment of the present invention.

The sectional shape of the conveying coil 340 is preferably circular. Alternatively, the sectional shape of the conveying coil 340 may be rectangular as shown in FIG. 9. Since the conveying coil 340 transfers the waste toner as much as the width of the spiral, the amount of the transferred waste toner is relatively small. Thus, the performance of transferring the waste toner is improved by further providing the auger 320 which transfers the waste toner by using the spiral wing 322.

Referring to FIGS. 7 and 8, an agitation member 410 is installed on the guide portion 400. The agitation member 410 moves on the inclined guide portion 400 and stirs the waste toner leaving the third duct 303 so that the waste toner enters in the waste toner storage container 200 without accumulating on the guide portion 400. One end portion 411 of the agitation member 410 is fixed to the guide portion 400 and the other end portion 412 extends toward the waste toner storage container 200 along the inclined guide portion 400. The agitation member 410 preferably comprises an elastic body, and is preferably constructed of a thin plate, although plastic or any other suitable material can be used.

Although an additional driving unit (not shown) for moving the agitation member 410 can be provided, in the present embodiment, the agitation member 410 is moved by being engaged with the transfer unit 350. Referring to FIGS. 5, 7, and 8, a cam member 420 where a cam profile 421 is formed is coupled to the end portion 342 of the conveying coil 340 close to the waste toner storage container 200. The agitation member 410 contacting the cam profile 421 is reciprocally moved in a direction D of FIG. 8 as the cam member 420 rotates together with the conveying coil 340.

The first duct 301 may be installed so that the waste toner freely falls from the cleaning unit 120 into the second duct 302. Alternatively, as shown in FIG. 6, the first duct 301 may be installed and inclined downward from the cleaning unit 120 toward the second duct 302 so that the waste toner slides down and enters in the second duct 302.

The operation and effect of the waste toner transfer apparatus 300 is described below with reference to FIGS. 5 through 8.

The waste toner removed from the photoreceptive drum 101 by the cleaning apparatus 120 enters the second duct 302 via the first duct 301. When the drive motor 360 rotates, the auger 320 in the second duct 302 rotates and the conveying coil 340 in the third duct 303 rotates together. The waste toner in the second duct 302 enters in the third duct 303 by being pushed by the spiral wing 322 of the auger 320 and is transferred to the waste toner storage container 200 along the conveying coil 340.

The waste toner leaving the third duct 303 falls on the inclined guide portion 400 and slides into the waste toner storage container 200 by gravity. In this case, part of the waste toner falling on the guide portion 400 does not enter the waste toner storage container 200 due to an attraction force between the toner particles and tends accumulate on the guide portion 400. Accordingly, the guide portion 400 may clog in time. To prevent this, in the waste toner transfer apparatus 300 according to an embodiment of the present invention, the agitation member 410 is installed on the guide portion 400. As the conveying coil 340 rotates, the agitation member 410 contacting the cam member 420 moves to stir the waste toner accumulated on the guide portion 400. Thus, the waste toner falling on the guide portion 400 enters the storage container 200.

As described above, in the electrophotographic printer according to the embodiments of the present invention, since the agitation member is provided, the waste toner effectively enters the waste toner storage container by gravity and the movement of the agitation member, without being accumulated on the guide portion.

While this invention has been particularly shown and described with reference to embodiments thereof, it will be understood by those skilled in the art that various changes in form and details may be made therein without departing from the spirit and scope of the invention as defined by the appended claims.

What is claimed is:

1. A waste toner transfer apparatus in an electrophotographic printer for transferring waste toner removed by a cleaning unit to a waste toner storage container, the waste toner transfer apparatus comprising:

a duct connecting the cleaning unit and the waste toner storage container;

a transfer unit installed in the duct to transfer the waste toner comprising a rotating conveying coil;

a cam member having a cam profile is coupled to one end portion of the conveying coil;

a guide portion disposed at an outlet of the duct and inclined downward to guide the waste toner toward the waste toner storage container; and an agitation member installed on the guide portion and moving to prevent the waste toner from accumulating on the guide portion.

2. The waste toner transfer apparatus as claimed in claim 1, wherein the transfer unit further comprises a rotating shaft, wherein the conveying coil is coupled to the shaft for rotating and, as the cam member rotates, the agitation member contacts the cam profile and moves.

3. The waste toner transfer apparatus as claimed in claim 1, wherein the transfer unit further comprises an auger having a shaft and a spiral wing formed on an outer circumference of the shaft for rotating, wherein the conveying coil is coupled to the shaft and rotating together with the auger and, as the cam member rotates, the agitation member contacts the cam profile and moves.

4. The waste toner transfer apparatus as claimed in claim 3, wherein the duct comprises:

a first duct in which the waste toner enters from the cleaning unit;

a second duct connected to the first duct; and a third duct which is soft and connects the second duct and the waste toner storage container, and the auger is installed in the second duct and the conveying coil is coupled to the auger and inserted in the third duct.

5. An electrophotographic printer comprising a cleaning unit for removing waste toner remaining on an image holding body, a waste toner storage container, and a waste toner transfer apparatus for transferring the waste toner from the cleaning unit to the waste toner storage container, wherein the waste toner transfer apparatus comprises:

a duct for connecting the cleaning unit and the waste toner storage container;

a transfer unit installed in the duct to transfer the waste toner comprising a rotating conveying coil;

a cam member having a cam profile is coupled to one end portion of the conveying coil;

a guide portion disposed at an outlet of the duct and inclined downward to guide the waste toner toward the waste toner storage container; and an agitation member installed on the guide portion and moving to prevent the waste toner from accumulating on the guide portion.

6. The electrophotographic printer as claimed in claim 5, wherein the transfer unit further comprises a rotating shaft, wherein the conveying coil is coupled to the shaft for rotating and, as the cam member rotates, the agitation member contacts the cam profile and moves.

7. The electrophotographic printer as claimed in claim 5, wherein the transfer unit further comprises an auger having a shaft and a spiral wing formed on an outer circumference of the shaft for rotating, wherein the conveying coil is coupled to the shaft and rotating together with the auger and, as the cam member rotates, the agitation member contacts the cam profile and moves.

8. The electrophotographic printer as claimed in claim 7, wherein the duct comprises:

a first duct in which the waste toner enters from the cleaning unit;

a second duct connected to the first duct; and a third duct which is soft and connects the second duct and the waste toner storage container, and the auger is installed in the second duct and the conveying coil is coupled to the auger and inserted in the third duct.

9. A method of transferring waste toner from a cleaning unit of an image holding body to a waste toner storage container, the method comprising the steps of:

cleaning waste toner from the image holding body;

guiding the waste toner toward the waste toner storage container via a guide portion disposed at an outlet of a duct and inclined downward; and agitating the waste toner to prevent the waste toner from accumulating on a guide portion via an agitating member installed on the guide portion and rotating a conveying coil coupled at one end to a cam member having a cam profile.

10. The method of claim 9, wherein the duct is connected between a cleaning unit adapted to perform the cleaning step and the storage container.

11. The method of claim 9, wherein the agitating step further comprises rotating the conveying coil via a shaft.

12. The method of claim 11, wherein the agitating step further comprises contacting the cam profile with the agitating member when the cam member rotates.

13. The method of claim 9, further comprising the step of rotating a transfer unit, wherein the transfer unit comprises the conveying coil.

14. The method of claim 13, wherein the rotating transfer unit comprises an auger having a shaft and spiral shaped wings formed on an outer circumference of the shaft.

15. The method of claim 13, wherein the agitating step further comprises rotating a conveying coil and the auger via the shaft.

16. The method of claim 9, wherein the agitating step further comprises contacting the cam profile with the agitating member when the cam member rotates.

* * * * *